US007313941B1

(12) United States Patent
Chuang

(10) Patent No.: US 7,313,941 B1
(45) Date of Patent: Jan. 1, 2008

(54) CORRUGATED SHEET MEMBER BENDING MACHINE

(76) Inventor: Sen-Jung Chuang, No. 90-10, Hsia Kwei Jou San, Tan Shui Chen, Taipei County (TW)

( * ) Notice: Subject to any disclaimer, the term of this patent is extended or adjusted under 35 U.S.C. 154(b) by 57 days.

(21) Appl. No.: 11/291,921

(22) Filed: Dec. 2, 2005

(51) Int. Cl.
*B21D 5/01* (2006.01)
*B21D 5/14* (2006.01)

(52) U.S. Cl. ..... 72/307; 72/379.6

(58) Field of Classification Search ..... 72/181, 72/379.6, 379.2, 168, 177, 307, 385
See application file for complete search history.

(56) References Cited

U.S. PATENT DOCUMENTS 2,350,379 A * 6/1944 Weightman ..... 72/321
2,775,284 A * 12/1956 Hermann ..... 72/168
2,944,583 A * 7/1960 Welindt ..... 72/380
3,874,214 A * 4/1975 Racicot ..... 72/307
4,580,433 A * 4/1986 Aberg ..... 72/379.6
4,603,572 A * 8/1986 Van Breukelen et al. ..... 72/385
4,660,399 A * 4/1987 Suter et al. ..... 72/181
4,864,837 A * 9/1989 Fielden, Jr. ..... 72/176

* cited by examiner

*Primary Examiner*—Daniel C Crane
(74) *Attorney, Agent, or Firm*—Troxell Law Office, PLLC

(57) ABSTRACT

A corrugated sheet member bending machine is disclosed to include a base frame, a housing pivotally supported on the base frame and turnable within 90-degrees to fit different workpiece insertion angles and different workpieces, a set of drive rollers mounted on a wheel shaft and rotatable by a motor, a set of driven rollers pivotally supported on a sliding plate movable relative to the drive rollers by a hydraulic cylinder, a bottom die fixedly mounted inside the housing at the bottom, and a movable upper die movable by a hydraulic cylinder for stamping on the inserted workpiece against the bottom die to curve the workpiece.

4 Claims, 9 Drawing Sheets

CORRUGATED SHEET MEMBER BENDING MACHINE

BACKGROUND AND SUMMARY OF THE INVENTION

The present invention relates to a corrugated sheet member bending machine and more particularly, to a simple structure of corrugated sheet member bending machine, which saves much installation space and fits different workpiece insertion angles.

Regular corrugated sheet members are made in a flat shape for covering the flat roof of a building. When encountered a curved area on the roof, a plastic sheet member may be used to join two flat type corrugated sheet members and to cover the curved area of the roof. However, the use of a plastic sheet member to join two corrugated sheet members obstructs the total sense of beauty. In order to eliminate this drawback, a corrugated sheet member bending machine is developed and used to bend a corrugated sheet member subject to the desired shape. FIGS. 1 and 2 show a corrugated sheet member bending machine according to the prior art. This design of corrugated sheet member bending machine is still not satisfactory in function because of the following drawbacks:

1. Because the machine has a hydraulic mechanism 91 installed in the front side of the base 9 and a material feeder 92 installed in the rear side, the machine has a certain length that requires much factory floor space.

2. When wishing to bend the front, rear and middle parts of a corrugated sheet member 8, the operator must operate the hydraulic mechanism 91 and the mold 94 to stamp the front part of the corrugated sheet member 8, and then adjust the clamp 93 to clamp a different part of the corrugated sheet member 8, and then operate the hydraulic mechanism 91 and the mold 94 to stamp the middle part of the corrugated sheet member 8, and then adjust the clamp 93 to clamp another different part of the corrugated sheet member 8, and then operate the operate the hydraulic mechanism 91 and the mold 94 to stamp the rear part of the corrugated sheet member 8. This operation procedure is complicated.

The present invention has been accomplished under the circumstances in view. It is one object of the present invention to provide a corrugated sheet member bending machine, which is practical to bend the front side, rear side as well as both the front and rear sides of the workpiece. It is another object of the present invention to provide a corrugated sheet member bending machine, which fits different corrugated sheet members of different sizes and specifications. It is still another object of the present invention to provide a corrugated sheet member bending machine, which saves much installation space. According to the present invention, the corrugated sheet member bending machine comprises a base frame, a housing pivotally supported on the base frame and turnable within 90-degrees to fit different insertion angles and different workpieces, a set of drive rollers mounted on a wheel shaft and rotatable by a motor, a set of driven rollers pivotally supported on a sliding plate movable relative to the drive rollers by a hydraulic cylinder, a bottom die fixedly mounted inside the housing at the bottom, and a movable upper die movable by a hydraulic cylinder for stamping on the inserted workpiece against the bottom die to curve the workpiece. Further, the drive rollers and the driven rollers are set close to the upper die and the bottom die, thereby saving much installation space.

DETAILED DESCRIPTION OF THE INVENTION

Figure 1:
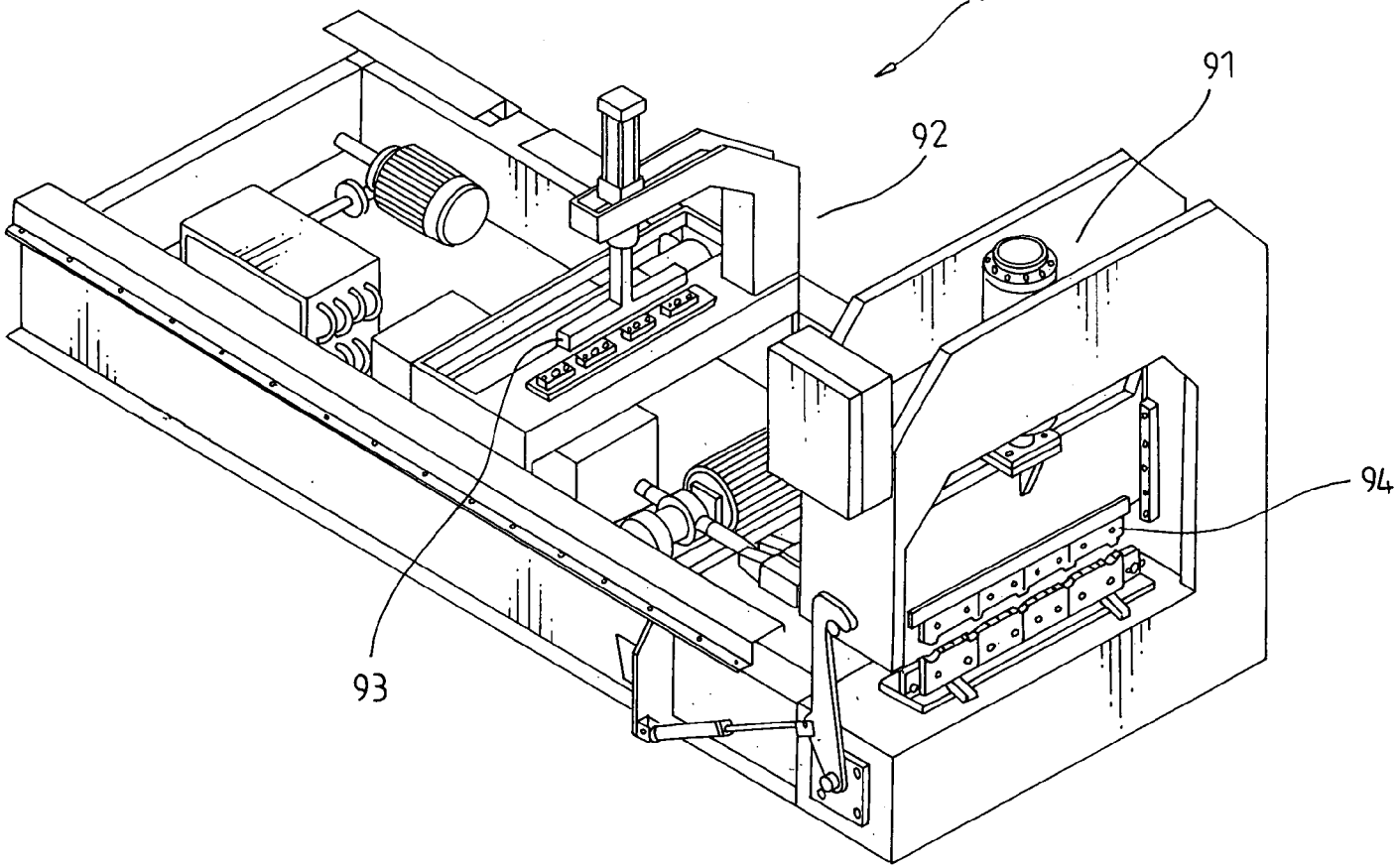
Fig. 1 PRIOR ART
FIG. 1 is a perspective view of a corrugated sheet member bending machine according to the prior art.
Figure 2:
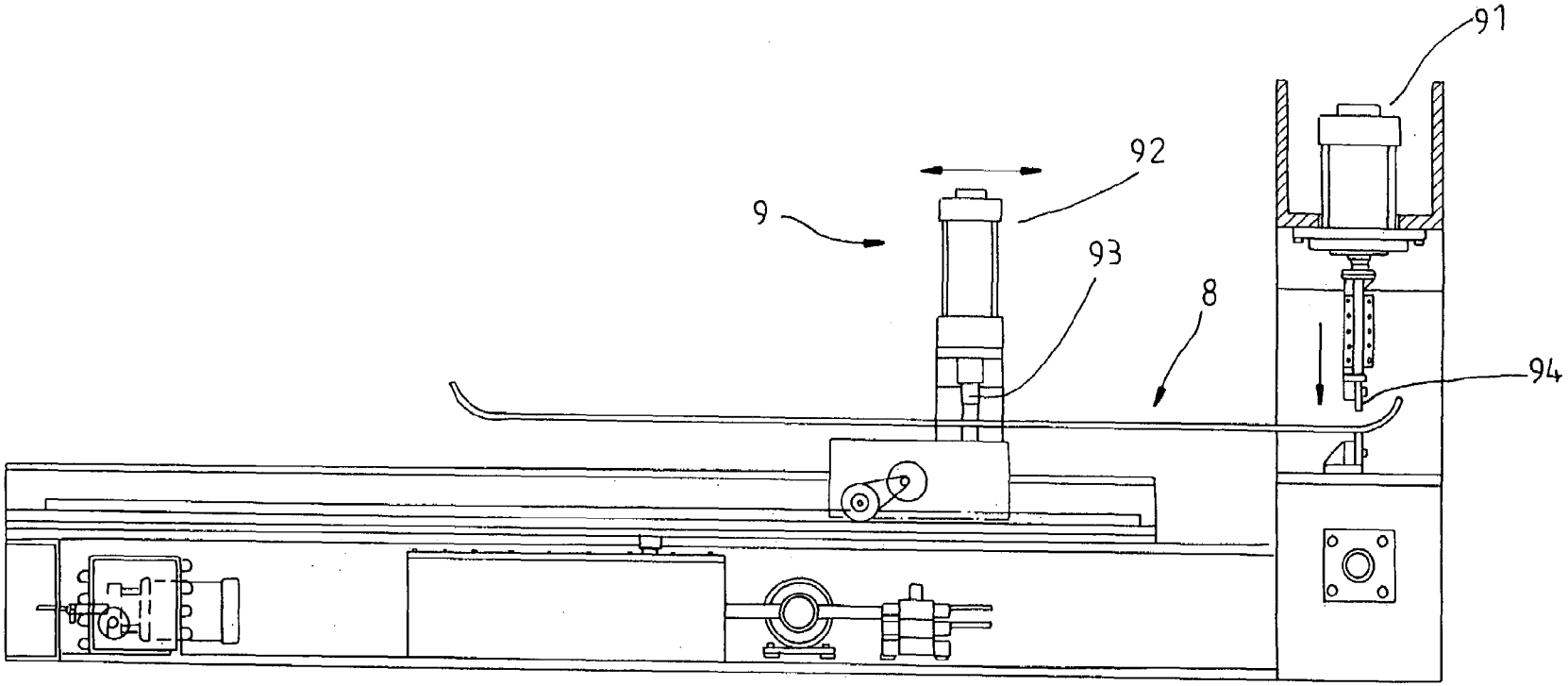
Fig. 2 PRIOR ART
FIG. 2 is a schematic front plain view of the prior art corrugated sheet member bending machine.
Figure 3:
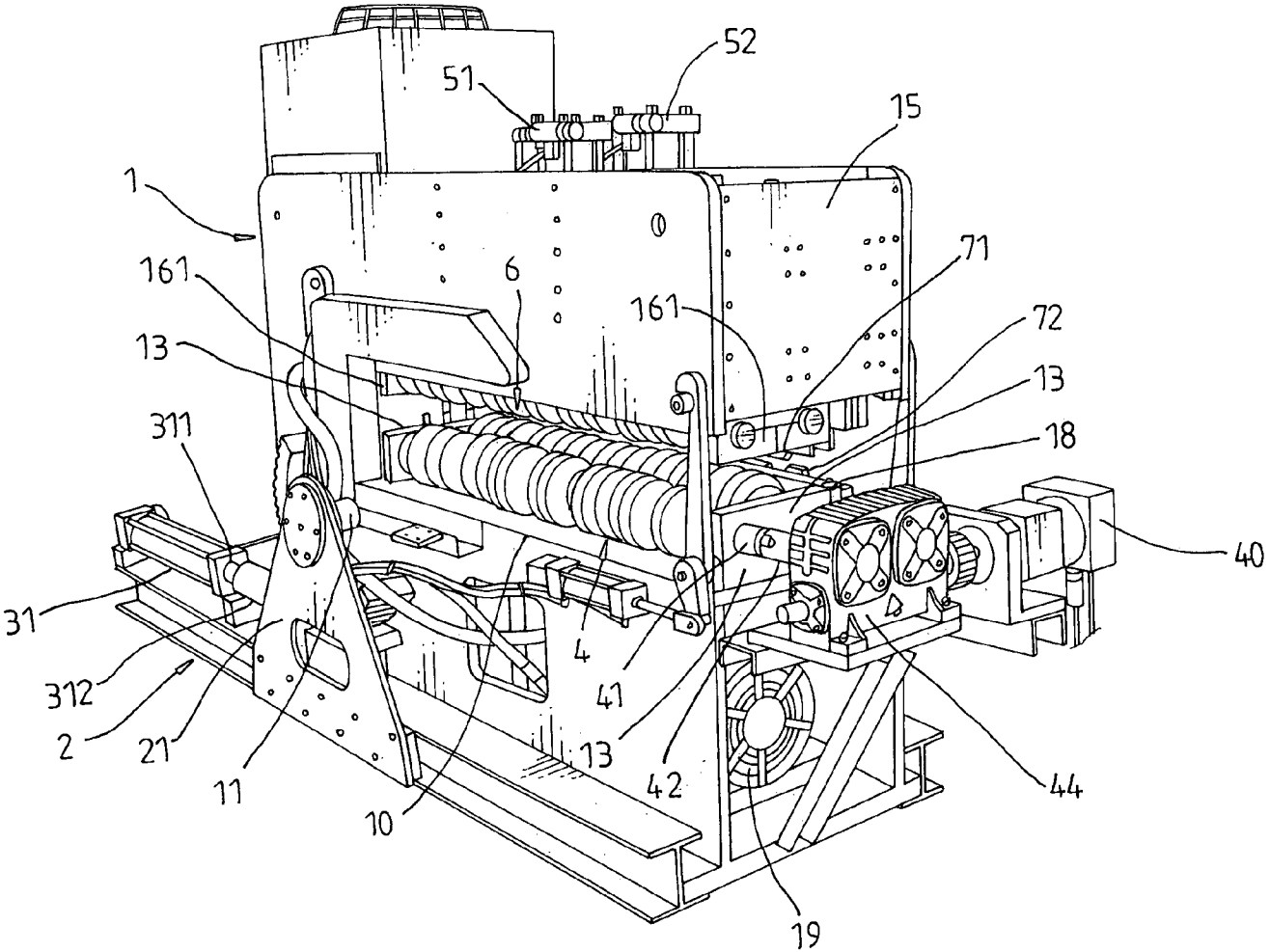
FIG. 3 is a perspective view of a corrugated sheet member bending machine according to the present invention.
Figure 4:
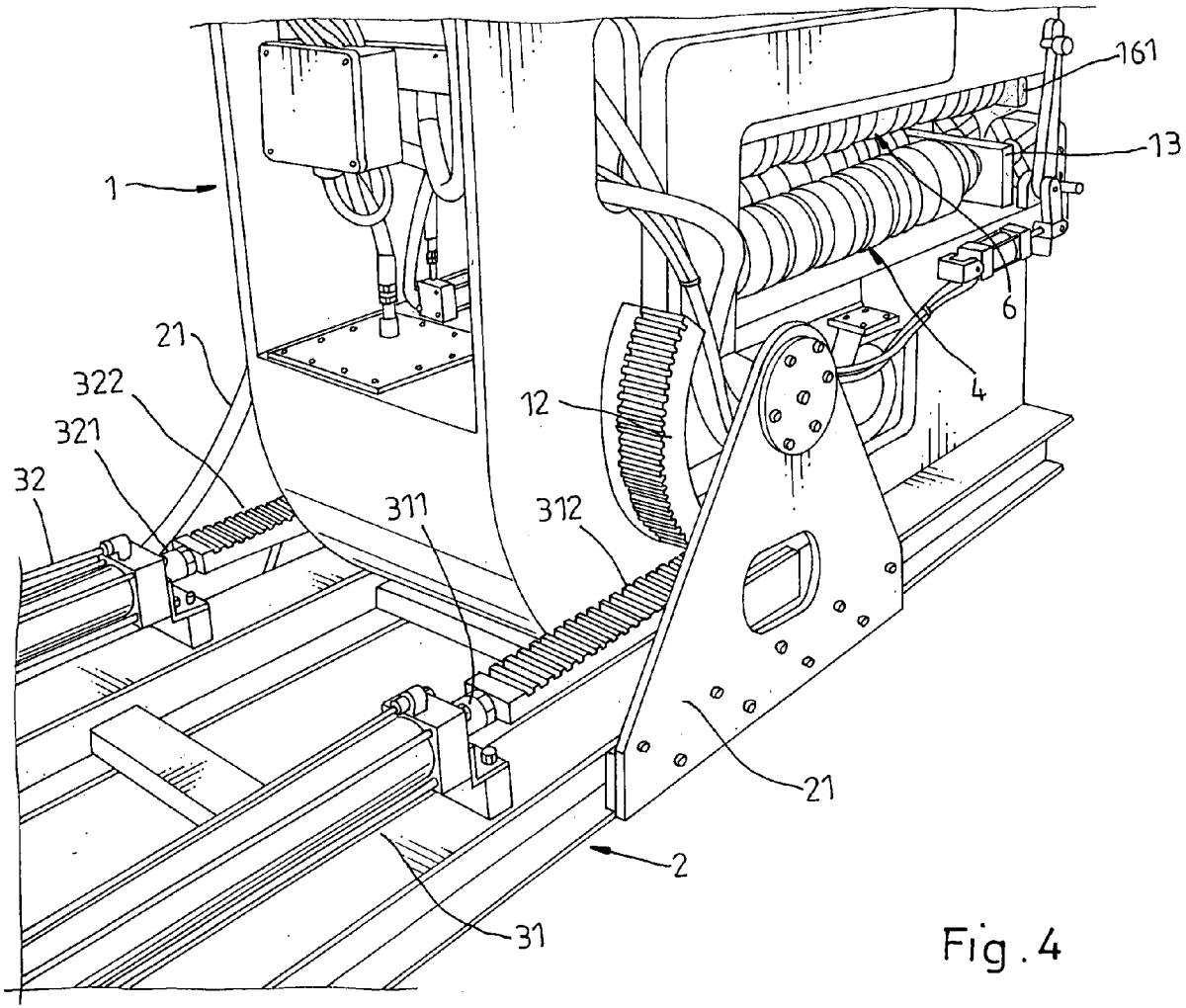
FIG. 4 is an enlarged view of a part of the corrugated sheet member bending machine according to the present invention.
Figure 5:
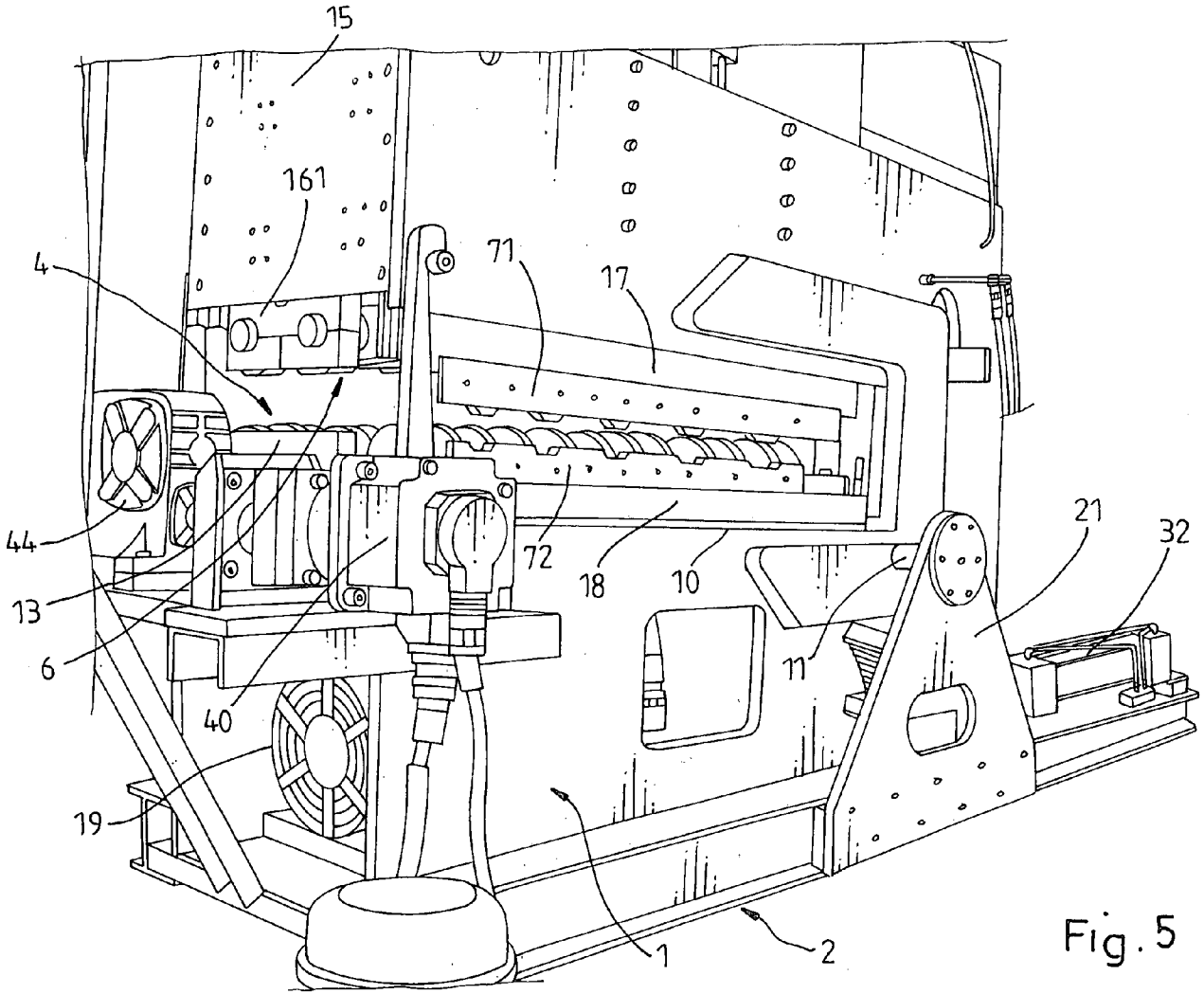
FIG. 5 is an enlarged view of another part of the corrugated sheet member bending machine according to the present invention.
Figure 6:
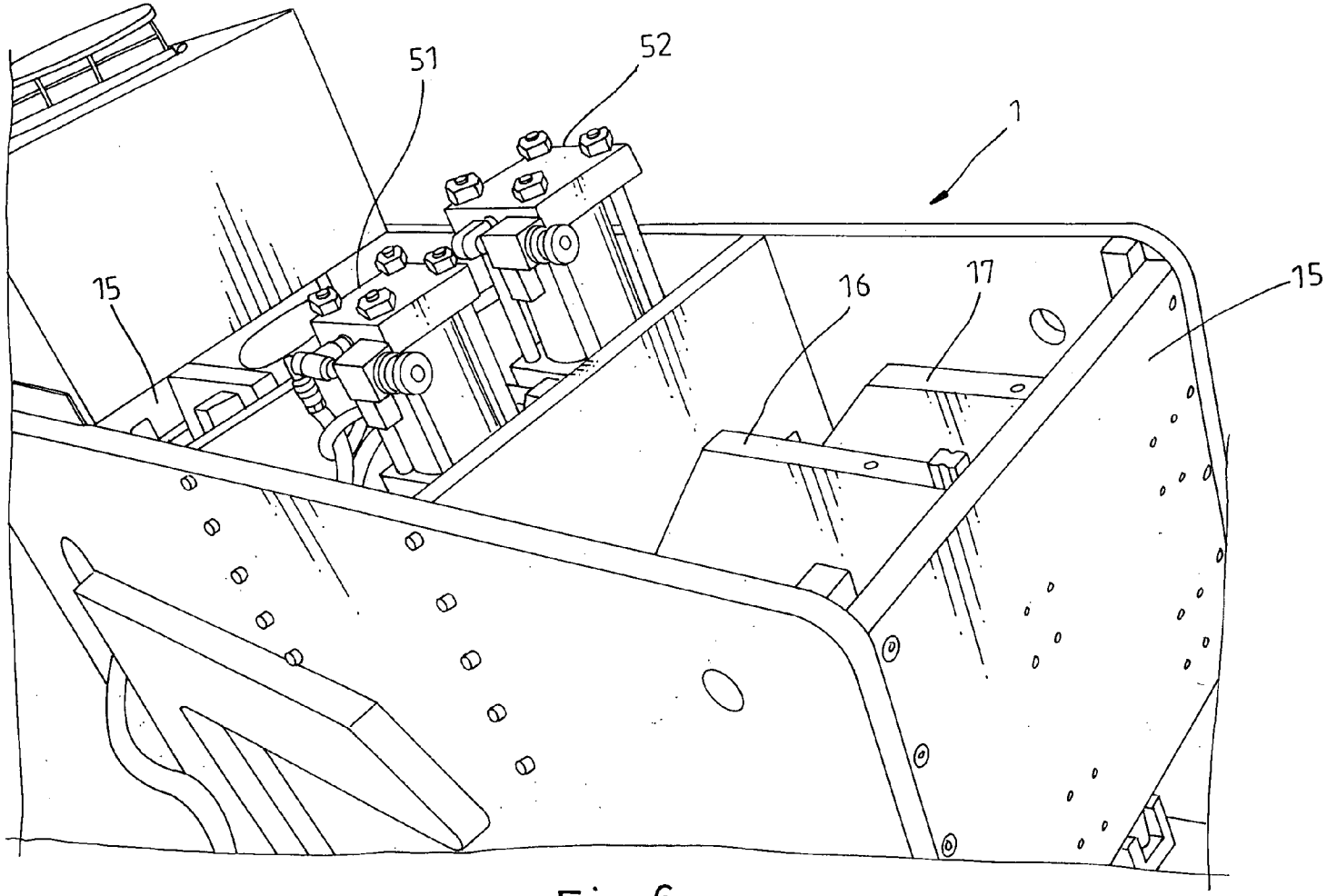
FIG. 6 is an enlarged view of still another part of the corrugated sheet member bending machine according to the present invention.
Figure 7:
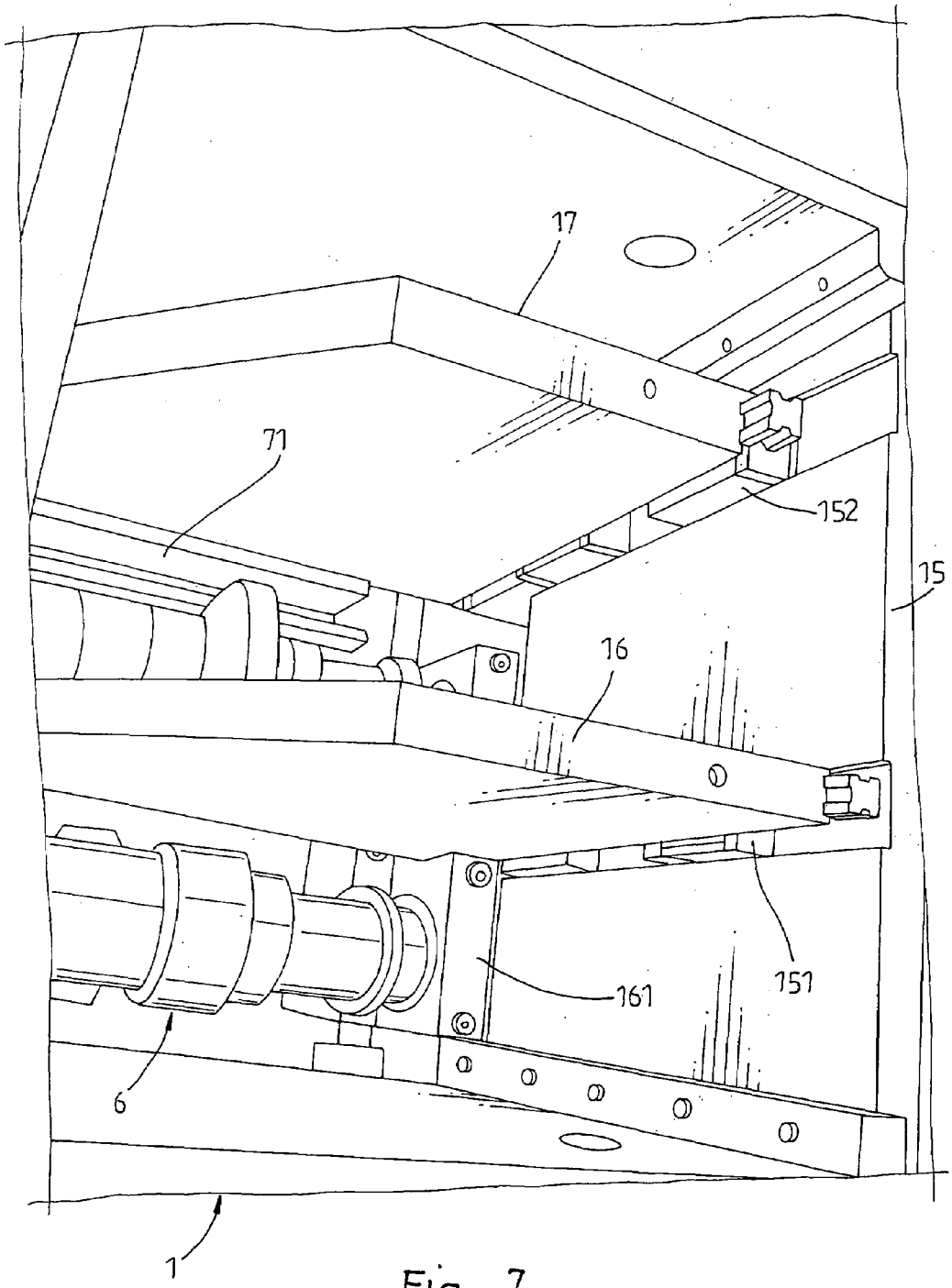
FIG. 7 is an enlarged view of still another part of the corrugated sheet member bending machine according to the present invention.
Figure 8:
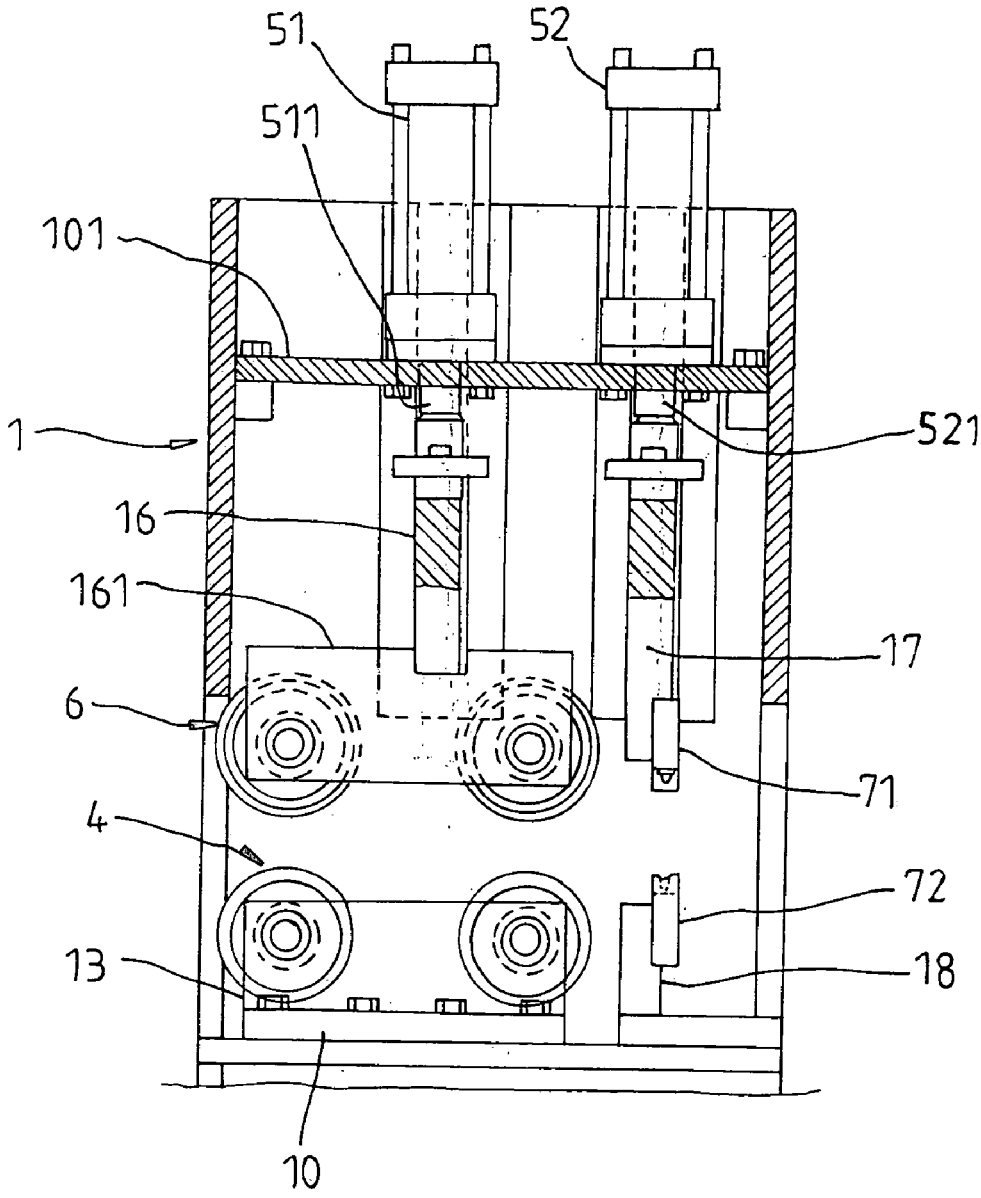
FIG. 8 is a schematic sectional plain view of the corrugated sheet member bending machine according to the present invention.
Figure 9:
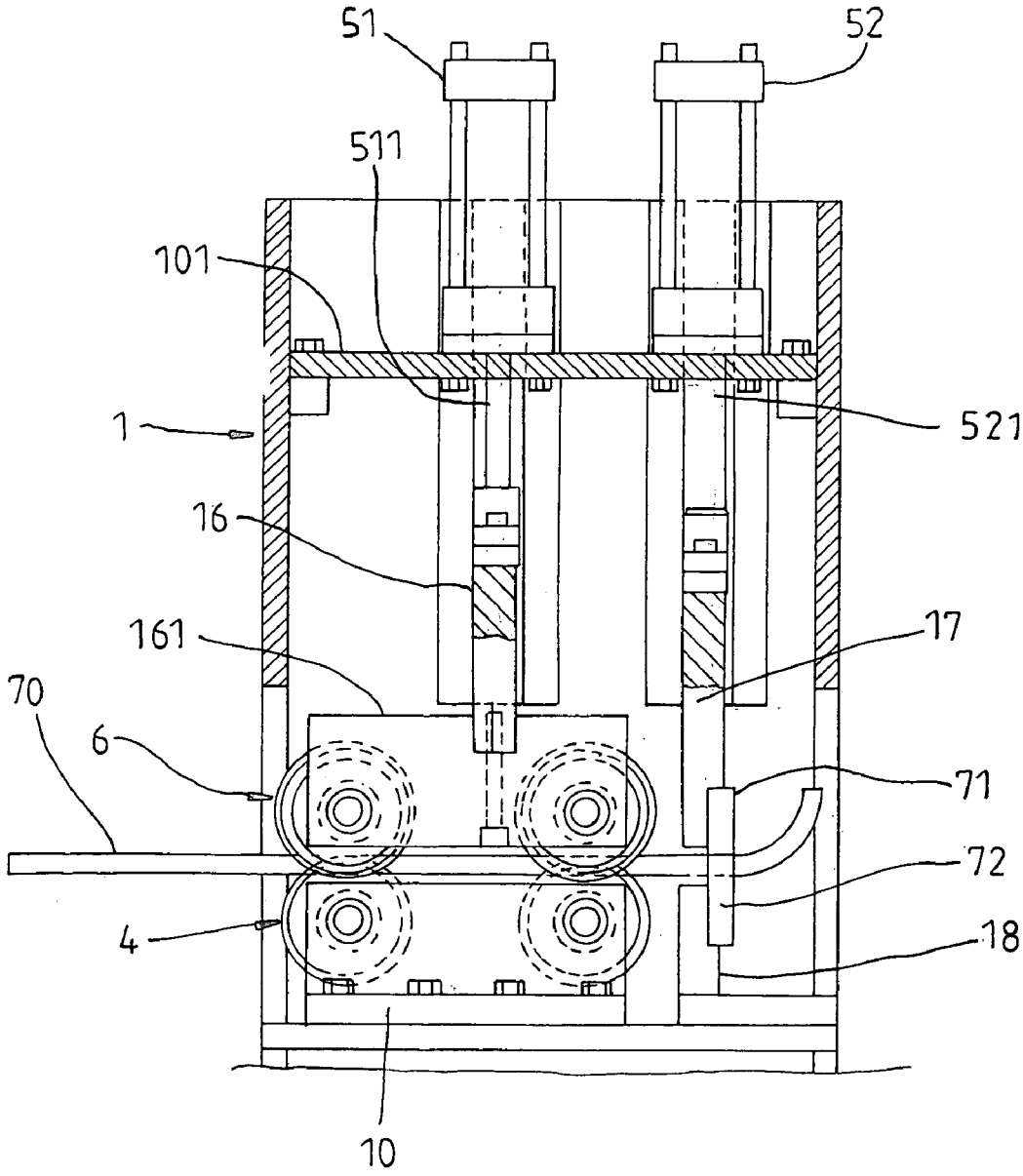
FIG. 9 is a schematic sectional plain view of the corrugated sheet member bending machine according to the present invention.

Referring to FIGS. 3-9, a corrugated sheet member bending machine in accordance with the present invention is shown comprising a base frame 2, two upright supports 21 symmetrically disposed at front and rear sides of the base frame 2, two sliding racks 312 and 322 arranged in parallel on the top wall of the base frame 2 near the front and rear sides of the base frame 2, a housing 1 pivotally supported on the upright supports 21 by a pivot shaft 11, two gears 12 fixedly provided at the front and sides of the housing 1 and respectively meshed with the sliding racks 312 and 322 (see FIG. 4), and two hydraulic cylinders 31 and 32 respectively mounted on the top wall of the base frame 2 and coupled with the respective piston rods 311 and 321 to the sliding racks 312 and 322. By means of operating the hydraulic cylinders 31 and 32 to extend out the respective piston rods 311 and 321, the sliding racks 312 and 322 are moved to rotate the gears 12, and therefore the housing 1 is turned with the pivot shaft 11 relative to the machine base 2 through an angle, for example, 90°.

Further, the housing 1 comprises a rectangular table 10, two locating blocks 13 fixedly provided at the top side of the table 10 near the two ends (left and right sides) of the table 10, a wheel shaft 41 pivotally supported on the locating blocks 13, a set of drive rollers 4 respectively fixedly mounted on the wheel shaft 41, a transmission gear set 44 (speed reduction gear box) coupled to one end of the wheel shaft 41 through a coupling 42, and a motor 40 adapted to rotate the wheel shaft 41 and the drive rollers 4.

Further, two locating plates 15 are respectively fixedly provided at the left and right sides of the housing 1 at the top and arranged in parallel (see FIG. 6) to support two sets of slide holders 151 and 152 and two sliding plates 16 and 17 at the slide holders 151 and 152. Two hydraulic cylinders 51 and 52 are supported on a mount 101 at the top of the housing 1 (see FIG. 8), having the respective piston rods 511 and 521 respectively coupled to the sliding plates 16 and 17. Two wheel holder plates 161 are fixedly provided at the sliding plate 16 to support a wheel shaft (not shown) and a set of driven rollers 6 on the wheel shaft corresponding to the drive rollers 4. The drive rollers 4 and the driven rollers 6 are shaped subject to the pattern of the corrugated sheet member 70 to be made. The sliding plate 17 holds an upper die 71. A bottom die 72 is provided at a mold holder 18 at the table 10 corresponding to the upper die 71. The upper die 71 and the bottom die 72 are matched to fit the shapes of the drive rollers 4 and the driven rollers 6.

Further, a hydraulic pump 19 is provided inside the housing 1, and adapted to control the operation of the hydraulic cylinders 31, 32, 51 and 52. When wishing to bend a part of a corrugated sheet member 70, insert the corrugated sheet member 70 into the gap between the driven rollers 6 and the drive rollers 4, and then drive a control circuit assembly (not shown) to control the hydraulic pump 19 to extend out of the piston rod 511 of the hydraulic cylinder 51 and to further lower the driven rollers 6 to the inserted corrugated sheet member 70, and then start the motor 40 to rotate the drive rollers 4 and to further carry the corrugated sheet member 70 forwards to a predetermined distance, and then stop the motor 40, keeping the corrugated sheet member 70 clamped in between the driven rollers 6 and the drive rollers 4. At this time, control the hydraulic pump 19 to extend out of the piston rod 521 of the hydraulic cylinder 52 and to further lower the sliding plate 17 and stamp the upper die 71 on the corrugated sheet member 70 against the bottom die 72, thereby forming a folding trace on the corrugated sheet member 17. When stamping the upper die 71 on the corrugated sheet member 70 against the bottom die 72, the drive rollers 4 are stopped. After the stamping action, the drive rollers 4 are rotated again to deliver the stamped corrugated sheet member 70 forwards, thereby causing the corrugated sheet member 70 to be curved subject to the stamped pattern of the folding trace (see FIG. 9). By means of controlling the movement of the upper die 71, the front and rear parts of the corrugated sheet member 70 are respectively curved as desired.

As indicated above, the invention provides a corrugated sheet member bending machine, which has the following features:

1. The corrugated sheet member bending machine is comprised of a housing 1, a base frame 2, drive rollers 4, driven rollers 6, hydraulic cylinders 31, 32, 51 and 52, an upper die 71, a bottom die 72, and other related parts. The drive rollers 4 and the driven rollers 6 are set close to the upper die 71 and the bottom die 72 to save much installation space of the machine.

2. The corrugated sheet member bending machine can be selectively controlled to curve the front or rear side, or both the front and rear sides of the inserted corrugated sheet member as desired, thereby saving much labor and work time.

3. The housing 1 can be turned upwards relative to the machine base 2 through an angle within 90°, for enabling the workpiece, i.e., the corrugated sheet member 70 to be inserted into the machine at any of a series of angles subject to different bending requirements. Therefore, the corrugated sheet member bending machine is practical to bend different corrugated sheet members of different sizes and different specifications.

What is claimed is:

1. A corrugated sheet member bending machine comprising a fixed base frame, a housing supported on said base frame, a bottom die fixedly provided inside said housing, first and second sliding plates mounted inside said housing, an upper die fixedly mounted on said second sliding plate, a second hydraulic cylinder adapted to move said second sliding plate toward said bottom die and to stamp said upper die on a corrugated sheet member being inserted into said housing against said bottom die to bend said corrugated sheet member, wherein said base frame comprises two upright supports symmetrically disposed at front and rear sides thereof, two sliding racks arranged in parallel on a top wall of said base frame, two hydraulic cylinders respectively mounted on said top wall and adapted to move said sliding racks; said housing is pivotally supported on said upright supports with a pivot shaft said sliding racks controlling the pivotal movement of said housing, said housing comprising a fixed table, two locating blocks fixedly mounted on said fixed table, a wheel shaft pivotally supported on said locating blocks, a set of drive rollers respectively fixedly mounted on said wheel shaft, a motor adapted to rotate said wheel shaft, two wheel holder plates mounted on said first sliding plate and holding a set of driven rollers corresponding to said drive rollers, and a first hydraulic cylinder adapted to move the first sliding plate that holds said wheel holder plates and said driven rollers and to approach said driven rollers to said drive rollers for feeding said corrugated sheet member to said dies.

2. The corrugated sheet member bending machine as claimed in claim 1, wherein said housing comprises two gears fixedly provided at front and sides thereof and respectively meshed with said two sliding racks for turning said housing relative to said base frame upon operation of the hydraulic cylinders at said base frame to move said two sliding tracks.

3. The corrugated sheet member bending machine as claimed in claim 1, wherein said drive rollers fit said driven rollers in configuration.

4. The corrugated sheet member bending machine as claimed in claim 1, further comprising a transmission gear set coupled between said motor and said wheel shaft, and a coupling coupled between said transmission gear set and said wheel shaft for enabling said motor to rotate said wheel shaft.

* * * * *